US006216590B1

(12) United States Patent
Whelan

(10) Patent No.: US 6,216,590 B1
(45) Date of Patent: Apr. 17, 2001

(54) LIGHT WEIGHT INTAGLIO PRINTING PRESS

(76) Inventor: Paul L. Whelan, 2901 Eisenhower St., Carrollton, TX (US) 75007

( * ) Notice: Subject to any disclaimer, the term of this patent is extended or adjusted under 35 U.S.C. 154(b) by 0 days.

(21) Appl. No.: 09/516,353

(22) Filed: Mar. 1, 2000

Related U.S. Application Data

(63) Continuation-in-part of application No. 09/368,679, filed on Aug. 5, 1999, now abandoned.

(51) Int. Cl.[7] ..... B41F 3/20; B41F 3/36

(52) U.S. Cl. ..... 101/158; 101/250; 101/252; 101/269

(58) Field of Search ..... 101/250, 251, 101/252, 253, 254, 256, 257, 260, 264, 269, 270, 272, 150, 158, 163

(56) References Cited

U.S. PATENT DOCUMENTS

| | | | | |
|---|---|---|---|---|
| 358,857 | * | 3/1887 | Henry | 101/269 |
| 404,058 | * | 5/1889 | Snow | 101/269 |
| 1,824,211 | | 9/1931 | Jobke | 72/241.1 |
| 3,577,917 | | 5/1971 | Nantz | 101/269 |
| 3,633,505 | | 1/1972 | Ferrari | 101/269 |
| 4,704,962 | | 11/1987 | Healey | 101/269 |
| 5,325,637 | * | 7/1994 | Yasuda et al. | 51/319 |
| 5,346,199 | * | 9/1994 | Martin et al. | 271/110 |
| 5,609,054 | | 3/1997 | Ogawa et al. | 72/14.1 |

* cited by examiner

*Primary Examiner*—Daniel J. Colilla
(74) *Attorney, Agent, or Firm*—Daniel Robbins

(57) ABSTRACT

The present invention employs a light weight fixed bed to support an intaglio plate, and discloses a print roller mounted on a movable trolley which is advanced across the intaglio plate causing the pressure of the print roller to effect the printing. The trolley is fabricated from light weight beams substantially forming the sides of a hollow box beam, and the print roller is stiffened by support of intermediate rollers tied to a trolley beam. This precludes the print roller from flexing under the load presented by the intaglio plate and the associated paper and felt material as the print roller under pressure traverses the plate. This allows the use of a lighter, smaller diameter print roller. Handwheels attached to the trolley provide spring loaded pressure to control the pressure of the print roller on the intaglio plate assembly. The trolley is driven across the bed and plate by a manually operated external drive wheel, which causes the print roller to rotate under pressure across the plate effecting printing as it rolls. Below the bed of the table is a lower roller attached to the trolley and circumfirentially in contact with the lower bed face. This roller provides support to the underside of the fixed bed to prevent its flexure under the pressure of the print wheel pressing on the plate assembly at the upper surface of the bed. Also supporting this lower roller are intermediate rollers secured to the horizontal lower trolley beam.

28 Claims, 4 Drawing Sheets

LIGHT WEIGHT INTAGLIO PRINTING PRESS

This application is a continuation-in-part of U.S. application Ser. No. 09/368,679 filed Aug. 5, 1999, now abandoned.

BACKGROUND OF THE INVENTION

1. Field of the Invention

This invention relates to a printing press, and in particular to a press for intaglio printing, including printing of etchings and engravings.

2. Description Relative to the Prior Art

The art of intaglio printing dates back at least to the 15th century, where it was practiced by such well known artists as Rembrandt and Durer. It has developed over time and continues as a method of graphic artistic expression to the present.

The forms of intaglio printing are characterized by having the art work incised on a flat plate (i.e., a printing block plate); either into a ground layer covering the plate or into the surface of the plate itself. The plate surface used, and the means of forming the lines of the print determine the actual classification of the work. However, all intaglio processes involve filling the incised lines of the plate's finished drawing with ink, and carefully removing all remnants of ink from the flat, uncut surfaces of the plate. The plate is then covered with an appropriately wetted print paper (i.e., print fabricating material) which is in turn covered with resilient layers of material such as felt, and then run through a press which applies pressure to the felt and paper forcing it down into the inscribed lines of the plate so that ink is picked up and transferred to the paper.

Because paper fibers must be forced down into the lines and grooves of the inked plate to effect the ink transfer, large forces, uniform across the width of the plate, must be applied to the felt/paper layers as they traverse the press. Presses of the prior art utilize a fixed structure on which is mounted a massive movable bed onto which the plate is laid for printing. The bed is generally propelled by a lower driven roller which causes the plate to move on auxiliary rollers along the length of the table carrying the plate beneath the fixed print roller. The print roller, supported on end bearings fixed in heavy brackets secured to the table, is pressed down onto the felt/paper layers with pressure sufficient to effect the ink/paper transfer as the bed is rolled along the table in a plane parallel to, and at a fixed distance from, the print roller axis, by an appropriate motive means. In the prior art, the print rollers have been substantial steel cylinders with diameters of from 4" and up, and the lower rollers consisting of steel cylinders with diameters of from 3" and up. These heavy rollers are used to provide uniform pressure and to maintain straightness and parallelism over their full widths of the bed from 12" to several feet, and require heavy, rigid support structures. The bed itself must be weighty to resist flexing under the printing forces. Thus the intaglio press of the prior art is a heavy and unwieldy structure. The present invention provides performance equivalent to that obtainable by the presses of the prior art, but with a substantial reduction in complexity and weight.

SUMMARY OF THE INVENTION

Rather than using a heavy bed to support an intaglio plate and moving the bed and plate under a fixed print roller, the present invention teaches using a lighter weight fixed bed to support the intaglio plate and mounting the print roller on a movable trolley which is advanced across the intaglio plate causing the pressure of the print roller to effect the printing. The trolley is fabricated from light weight beams substantially forming the sides of a hollow box beam, and the print roller is stiffened by support of rollers tied to a trolley beam and in contact with the print roller at several intermediate points. These intermediate rollers, fixed to the upper beam, preclude the print roller from flexing under the load presented by the intaglio plate and the associated paper and felt material as the print roller under pressure traverses the plate. This allows the use of a lighter, smaller diameter print roller, and further reduces the weight and complexity of the print roller support assembly. Handwheels attached to the trolley provide spring loaded pressure to control the pressure of the print roller on the intaglio plate assembly. The trolley is driven across the bed and plate either by a manually operated external drive wheel or a geared motor, which causes the print roller to rotate under pressure across the plate effecting printing as it rolls. Below the bed of the table is a lower roller attached to the trolley and circumfirentially in contact with the lower bed face. This roller provides support to the underside of the fixed bed to prevent its flexure under the pressure of the print wheel pressing on the plate assembly at the upper surface of the bed. Also supporting this lower roller are intermediate rollers secured to the horizontal lower trolley beam to further provide uniform pressure and structural support during the printing process.

BRIEF DESCRIPTION OF THE DRAWINGS

The invention will be described with respect to the drawings of which.

DESCRIPTION OF THE PREFERRED EMBODIMENTS

Figure 1:
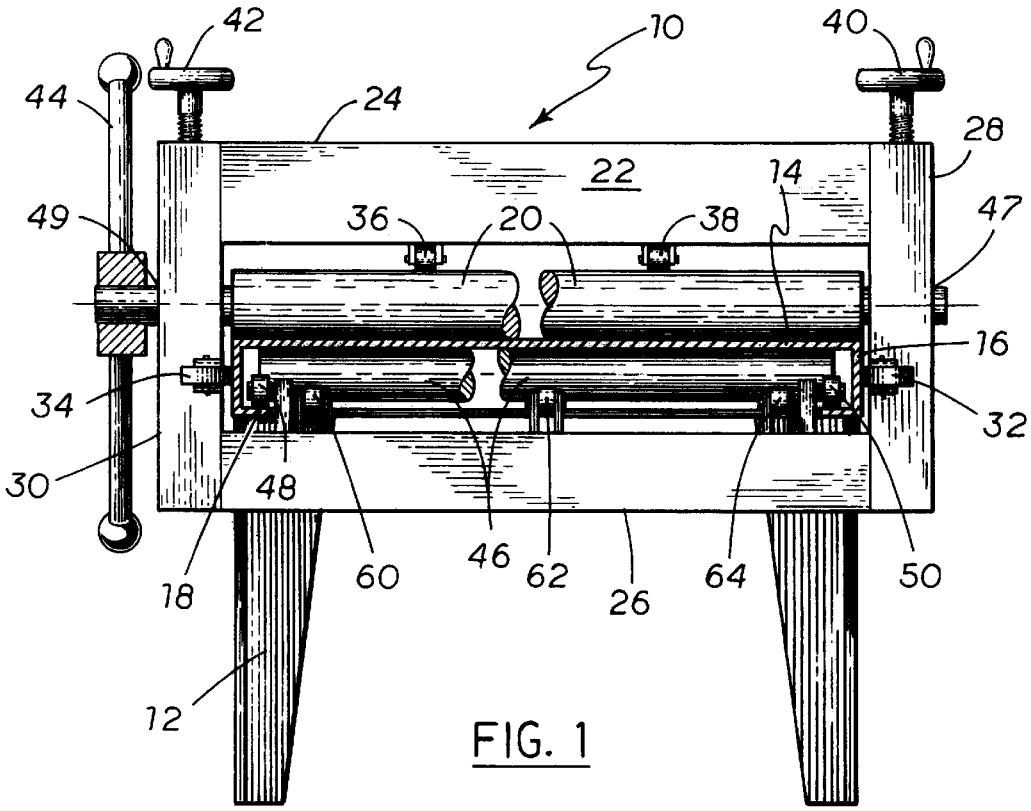
FIG. 1 is a cross-sectional drawing of an end view of the press of the invention.

Referring to FIG. 1, the press 10 of the invention consists of a fixed table structure 12 having an attached top flat bed 14 extending the full width and full length of the table 12, and fixed to it. In the process of printing an etching or engraving, an incised intaglio inked plate (not shown) will be secured to the bed 14 in a fixed position with its top surface overlaid with the print paper and a resilient felt blanket. Pressure onto the felt blanket provides the forcible contact between the paper and the incised plate. Along the width edges of the bed's 14 top surface are rigid sides 16 extending downwards, and attached to these sides 16 are inwardly facing platforms 18 extending the length of the table 14. A print roller 20, not fixed relative to the table structure 12, is part of a trolley assembly 22 whose travel across the bed 14 drives the print roller 20 over the stationary inked plate/paper/felt assembly positioned on the flat bed 14.

Figure 3:
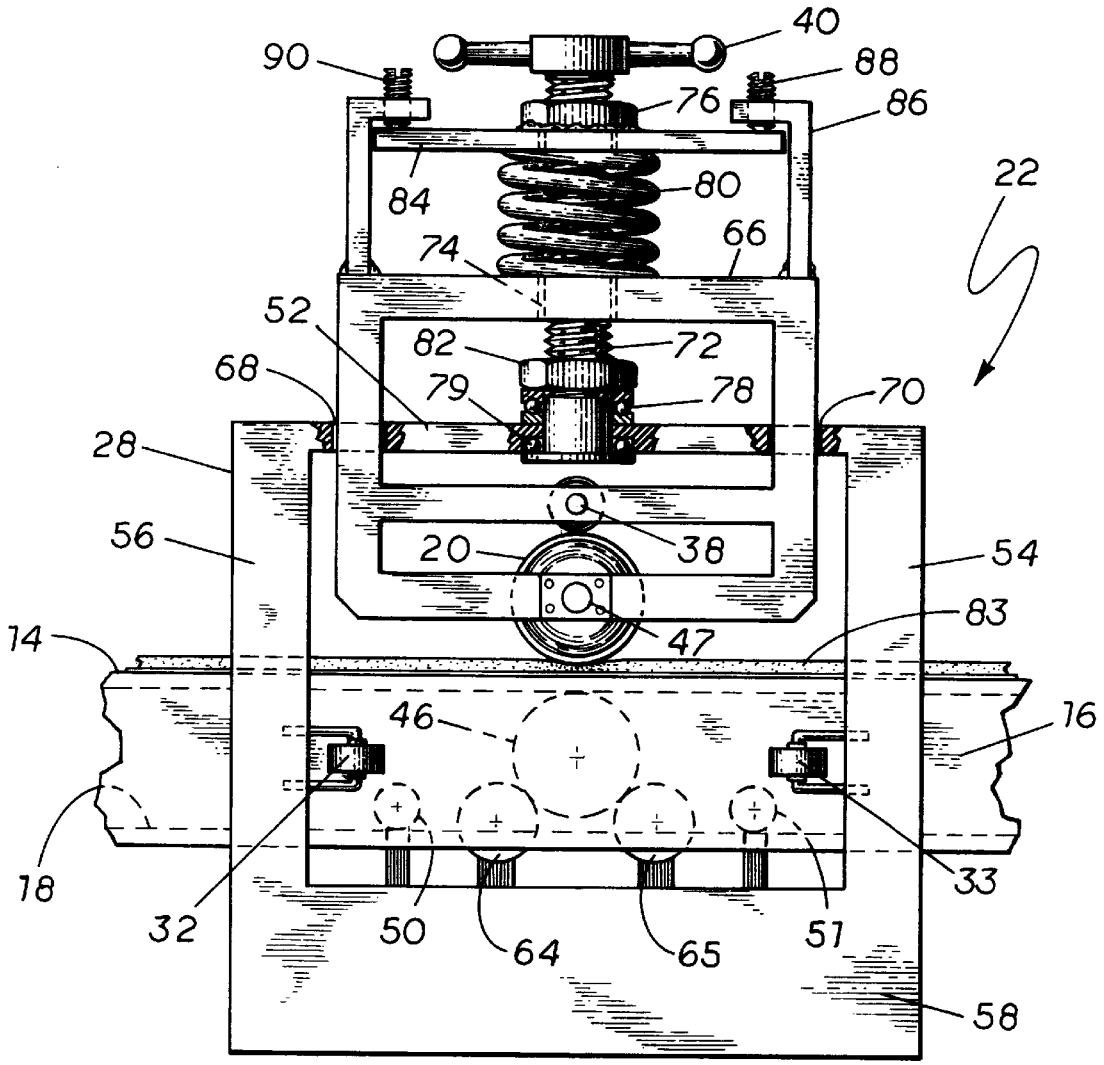
FIG. 3 is a drawing of a side elevation view of the trolley that is part of the press of the invention.

The trolley 22 has two vertical box like members 28,30 that form the sides of the trolley 22, and an upper beam 24, and lower beam 26 that form the top and bottom of the trolley 22. Referring to FIG. 1, the side members 28,30 are positioned alongside the rigid sides 16 of the table top 12, and the trolley is completed by the upper cross beam 24 tying the box members 28,30 together at the top end of the trolley, 22, i.e. above the bed 14, and the lower cross beam 26 tying them together at the bottom end of the trolley, i.e. below the bed 14. Thus the structure of the trolley 22 is substantially a hollow-like box enveloping the table 12. Attached to the vertical member 30 are two roller bearings of which only one, 34, is seen in FIG. 1, and to the vertical member 28 to be attached are two roller bearings 32,33, of which only one, 32, is seen in FIG. 1, which bear against the rigid sides 16 of the flat bed 14 and transversely guide the trolley 22 while it rolls the length of the table 12. Additionally, fixed to the upper surface of the lower beam 26 are the inner rings of radial bearings 48,50 whose outer races ride on the fixed platform 18, which support the lower portion of the trolley 22. (Corresponding bearings, of which one, 51, is seen in FIG. 3 are in mirror image positions relative to the bearings 48,50.)

The print roller 20 extending the width of the flat bed 14 is mounted in bearings 47,49 secured to the trolley's vertical members 28,30 so that the print roller 20 rides with the trolley 22. As will be explained below in connection with the operation of the pressure generating handwheels 40,42, pressure is applied downwardly at the ends of the print roller 20 to uniformly force it across the felt blanket covering the paper which is to be printed by the intaglio plate. Further extending from the upper beam 24 are two auxiliary roller bearings 36,38 in contact with the upper surface of the print roller 20 to maintain print roller 20 rigidity and parallelism against the considerable upward pressure exerted through the felt from the intaglio plate. A drive wheel 44 is coupled to the print roller 20 through bearings 47,49 and rotation of the drive wheel 44 propels the trolley 22 and the print roller 20 across the paper/felt/intaglio plate for printing. By a simple modification, a motor drive (not shown) may be used for moving the trolley 22 across the table in place of the drive wheel 44.

Similarly, a lower roller 46, equal approximately in length to the width of the bed 14, is located below the bed 14, and this roller is supported by intermediate bearings of which only 60, 62, 64 are seen in FIG. 1. These bearings are mounted in blocks connected to the lower beam 26. The lower roller 46 is in contact with the underside of the bed 14, and the lower roller's rigidity prevents the bed 14 from flexing during printing.

Figure 2A:
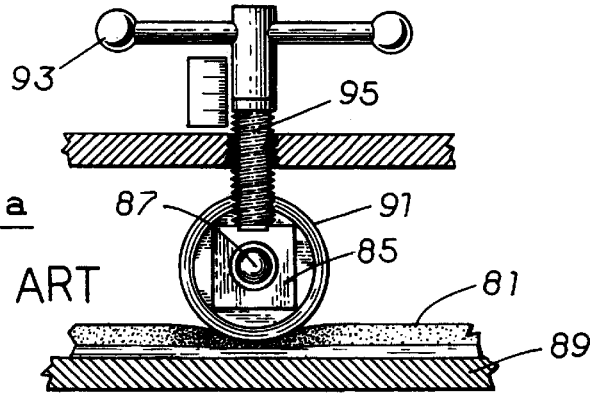
FIG. 2a PRIOR ART
FIG. 2*a* is a cross-sectional drawing of a prior art mechanism for applying pressure to a print roll.
Figure 2B:
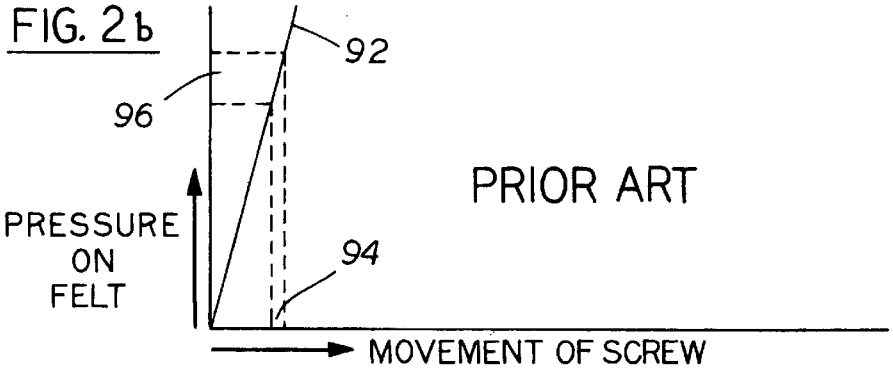
FIG. 2b PRIOR ART
FIG. 2*b* is a plot of the pressure v. screw position for the mechanism of FIG. 2*a,*

Before describing the inventive spring loading of the printing roll 20 disclosed in the present invention, it is advantageous to consider the method of positioning, and the pressure exerted by, the print roller as practiced in the prior art. Referring to FIG. 2*a,* a print roller 91 is shown positioned above a bed 89 covered by a felt/paper layer 81. The shaft 87 of the print roller 91 is fitted into a bearing pillow block 85 whose upper surface is in contact with the bottom of the screw 95. Rotation of the screw 95 by handle 93 pushes down on the bearing pillow block 85 to set the pressure of the print roller 91 on the bed 89 and felt 81. The felt, 81 which distributes the force over the plate, being comprised of organic fibers, has a relatively steep spring constant. From FIG. 2*b* which shows the linear relationship, 92, between the movement of the screw 95 and the pressure on the felt 81, it will be seen that a slight movement (94) of the screw 95 results in a relatively large change in the pressure (96) on the felt 81. The pressure control of the present invention solves this problem, as described below.

Referring to FIG. 3 one of the handwheel assemblies, e.g. 40, is seen in a detailed side view of the trolley 22. The structure of the other hand wheel assembly, e.g. 42 is substantially its mirror image. The side member of the trolley 22 labelled 28, (FIG. 1), viewed from the side is in the form of a box beam with a top member 52, side members 54, 56, and bottom member 58. Flat bed 14, rigid side wall 16 and platform 18 are shown oriented in the longitudinal direction, i.e. the direction of trolley 22 movement during printing.

Pressure is applied to the print roller 20 in the following manner. The print roller 20 is mounted on a bracket 66 which passes through holes 68,70 in the cross beam 52, so that bracket 66 is captive but can move vertically with respect to cross beam 52. Screw 72 clears a hole 74 in the top of the bracket 66, and the end of the screw 72 is locked by the nut 82 so it cannot move vertically with respect to the cross beam 52 of the trolley 22. The lower end of the screw 72 is mounted in bearings 78,79 which allows the screw 72 to solely rotate relative to the bracket 66 and to the cross beam 52. The lower end of the spring 80 is against the top of bracket 66, and the upper end of the spring 80 is against the bottom of the plate 84. The screw 72 is threaded through the nut 76 which is locked into place by being welded to a square plate 84. A housing 86 has a partially opened top surface through which the screw 72 easily passes, and the side walls of the housing 86 are adjacent to the edges of the plate 84 which restrict any rotational movement of the square plate 84. Rotation of the screw 72 by means of handle 40 compresses or relieves the spring 80 due to the vertical movement of the screw 72 relative to plate 84 and the nut 76. Hence, the advance or retraction of screw 72 and the resultant vertical movement of the plate 84 controls the degree of compression of spring 80 which generates the force applied between the top of the bracket 66 and square plate 84. The spring pressure applied to bracket 66 forces the bracket 66 down, (or allows it to move up), controlling the pressure at the line of contact of the print roller 20 against the felt 83 on the intaglio plate.

Figure 4:
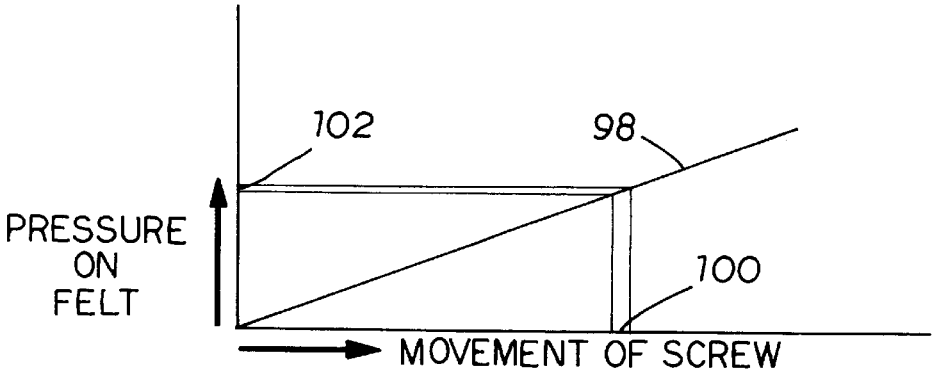
FIG. 4 is a plot of the pressure v. screw position for the screw mechanism of the invention.

The addition of the spring 80 to the screw assembly 72 allows the print roller 20 to move up and down with changes in print plate thickness, or with changes of the felt's spring constant due to varying moisture in the felt while maintaining substantially the same pressure on the plate and paper being printed. Referring to FIG. 4, the corresponding relation between screw motion and pressure at the roller for the spring assembly of the invention is seen. The overall slope of the spring rate/felt rate curve 98 may be made flatter, since it is controlled by the spring 80 rather than by the randomly variable spring constant of the felt 83. A small, readily controllable, change is screw position 100 results in a small pressure change of the roller on the felt 102, as compared to the large change 96 illustrated in FIG. 2*b,* as practiced in the prior art.

Figure 5:
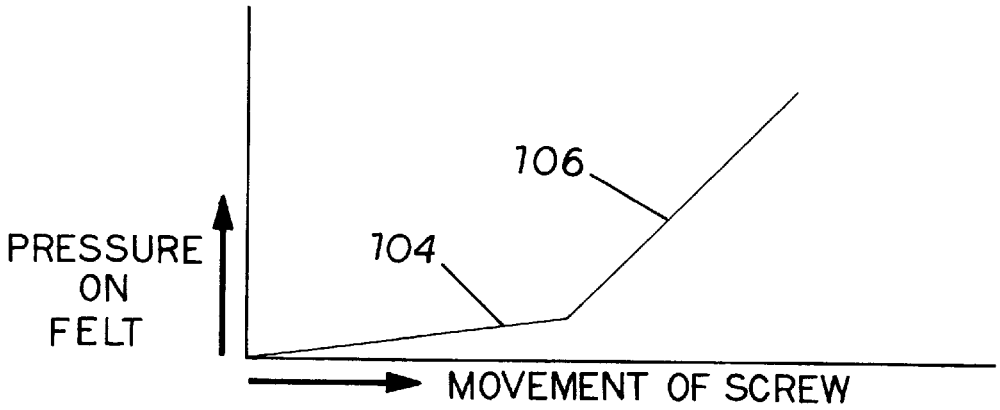
FIG. 5 is a plot of the pressure v. screw position for the screw mechanism of the invention for a dual action spring.

Additionally, the spring force may be made non-linear relative to rotation of the screw. Referring to FIG. 5, the initial spring rate (104) is seen to be very low, increasing (106) as the print roller continues to press into the felt. This allows the initial setup of the felt/paper at a minimal force between the print roller 20 and the felt/paper using a coarse adjustment of the screw 72, and after the felt/paper have been correctly position under the roller, a few additional screw turns generates the high pressure needed for printing.

At the four corners of the top lip of the housing 86 four screws are threaded through the lip, of which only screws 88,90 are seen in the view of FIG. 3. The positions of these threaded screws limit the upward motion of the plate 84, and accordingly the rise of the print roller 20 above the bed 14 under control of the handle 40.

Figure 6:
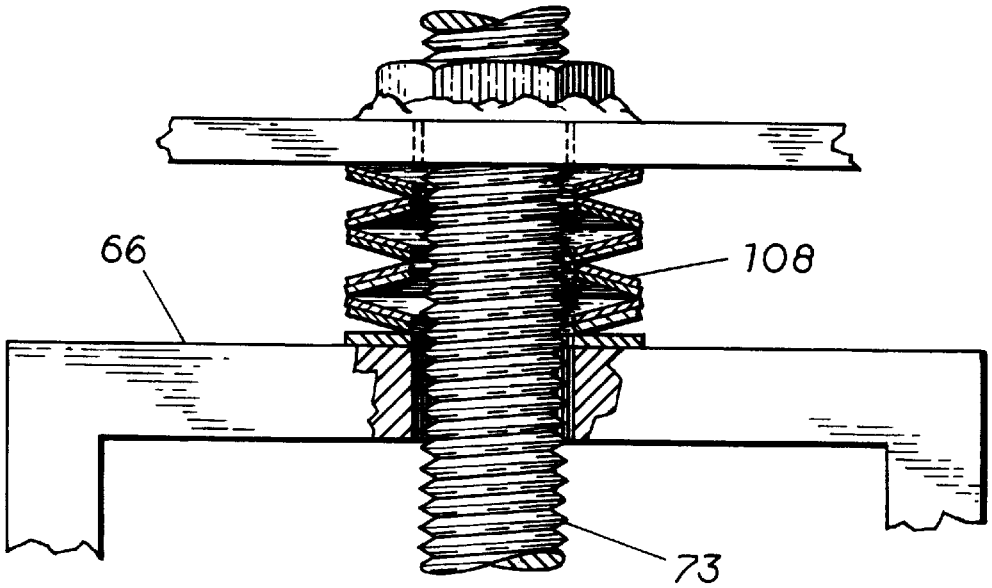
FIG. 6 is a drawing illustrating the screw mechanism of the invention with a dual action pressure generating spring.
Figure 7B:
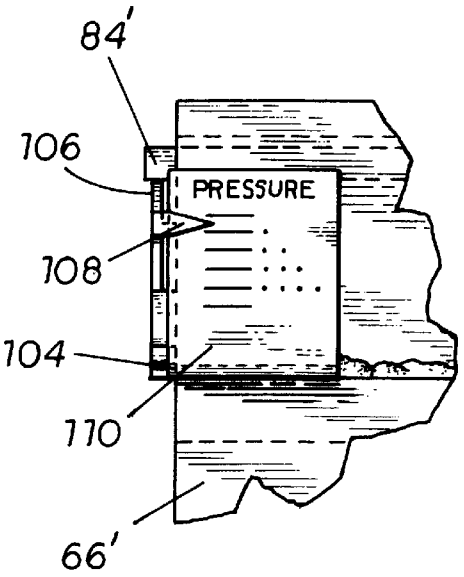
FIG. 7*b* is a partial drawing of the scale of the pressure indicator of FIG. 7*a* shown rotated through 90 degrees relative to FIG. 7*a*.
Figure 7A:
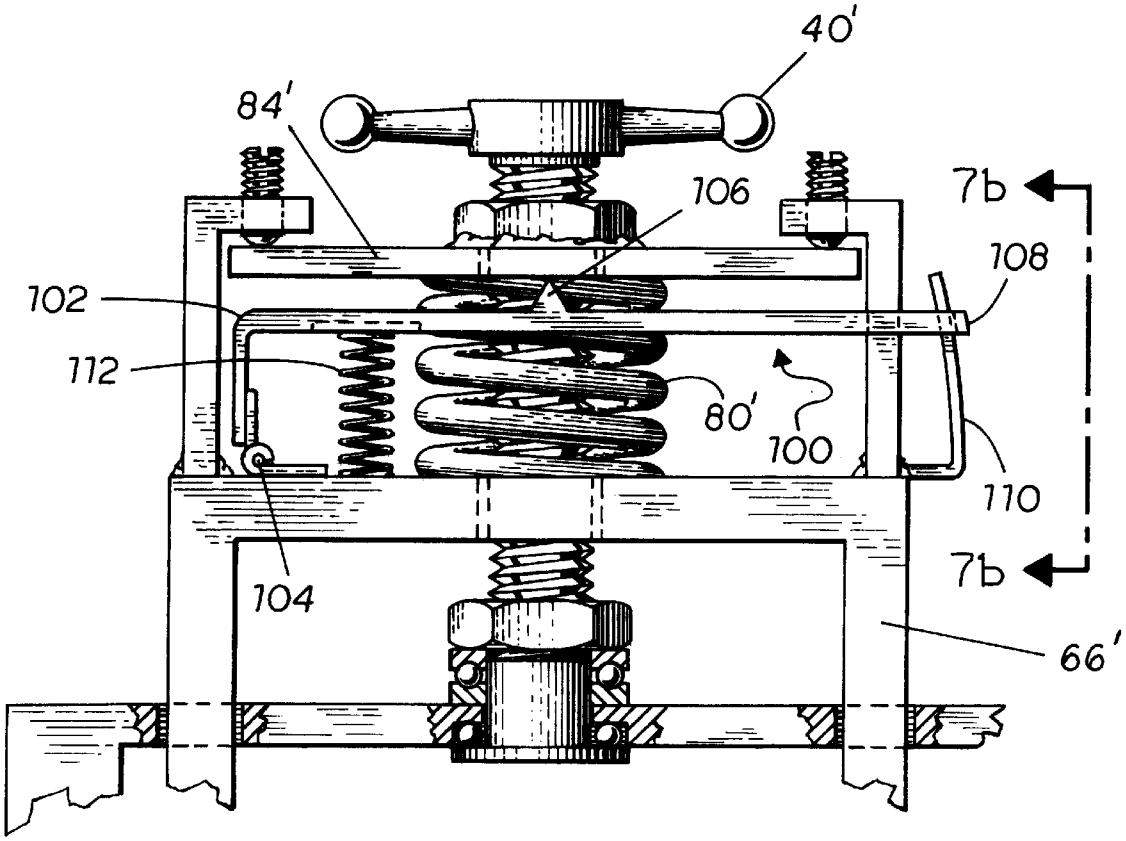
FIG. 7*a* is a partial elevation drawing of a pressure indicator for measuring the force applied by the print roller onto the intaglio plate.

In a second embodiment of the invention, a structure implementing a multiple constant spring is shown in FIG. 6, which may be used in setting print roll 20 pressure in place of the spring system of FIG. 3. A spring 108 (corresponding to the spring 80 of FIG. 3) surrounds a screw 73 (corresponding to screw 72). The spring 108 consists of a series of stacked Belleville disc spring washers , and it will be appreciated that by selecting differing heights and thicknesses for these washers 108, and stacking them in proper order, a dual constant spring arrangement may be effected. That is, a less stiff upper set of discs, followed by stiffer lower discs will provide the dual spring constant. FIG. 5 shows the resultant spring constant of the dual spring constant structure. Initially, the low spring constant (104) controls the pressure, but when this spring segment is full compressed, the stiffer spring constant (106) takes over. Other types of spring elements may be placed in series in an equivalent manner.

In a third embodiment of the invention, a pressure measuring indicator 100 is mounted on the bracket 66'. (In the drawings, different but related elements are identified with the same reference characters, albeit that corresponding elements in the various drawings are distinguished by primes.) The pressure measuring indicator 100 has an arm 102 that is pivoted at the point 104. A boss 106 on the arm 102 is in contact with the underside of plate 84'. As the handwheel 40' compresses the spring 80' by moving the plate 84', the arm 102 is deflected about the pivot point 104 due to the force on the boss 106 exerted by the plate 84'. A pointer 108 is mounted on the free end of the arm 102, and a juxtaposed pressure scale 110 is secured to the bracket 66'. Depending on the compression of the spring 80', the pointer 108 indicates on the scale 110 the corresponding pressure applied to the print roller. It will be noted that the boss 106 may be located anywhere along the portion of the arm adjacent to the plate 84'; the closer the boss 106 is to the pivot point 104 the greater the magnification of the swing of the pointer 108 over the scale 110 relative to the movement of the plate 84'. A light spring 112 biases the arm 112 so that the boss 106 remains in contact with the bottom of the plate 84'. It will be appreciated that in practice two of the disclosed indicators 100 are used on the press of the invention; each in association with a corresponding handwheel 40, 42, so that controlled pressures may be applied to each end of the print roller 20 (FIG. 1).

The invention has been described in detail with particular reference to preferred embodiments thereof, but it will be understood that variations and modifications can be effected within the spirit and scope of the invention. For example, while the invention has been described in terms of printing of etchings or engravings from an intaglio plate, it will appreciated that other forms of printing such as lithography, printing from handset type, or wood blocks may be practiced on the press of the invention. Applicant generically refers to use of "printing blocks" to inclusively cover the above broad printing techniques.

What is claimed is:

1. A printing press comprising:

a) a fixed stationary bed, b) a spring loaded print roller adapted for contacting and rotationally traversing said bed, c) at least a first support roller in contact with said print roller, and d) at least a second support roller in contact with said bed.

2. The spring loaded print roller of claim 1 further comprising first and second springs, wherein the pressure exerted by said springs are a linear function of the lengths of said springs.

3. The printing press of claim 2 further comprising first and second pressure indicators wherein the pressures exerted by said first and second springs are displayed.

4. The spring loaded print roller of claim 1 further comprising first and second springs wherein the pressure exerted by said springs are a nonlinear function of the lengths of said springs.

5. The printing press of claim 4 further comprising first and second pressure indicators wherein the pressures exerted by said first and second springs are displayed.

6. The spring loaded roller of claim 4 wherein said first and said second springs comprise the combination of spring components having two distinguishable spring constants.

7. The printing press of claim 6 further comprising first and second pressure indicators wherein the pressures exerted by said first and second springs are displayed.

8. The press of claim 6 wherein said first and said second nonlinear springs comprise first and second sets of stacked Belleville washers, said first and second sets differing in mechanical spring properties.

9. The printing press of claim 8 further comprising first and second pressure indicators wherein the pressures exerted by said first and second springs are displayed.

10. A printing press comprising:

a) a fixed bed having a length and a width, said bed having an upper surface and a lower surface, b) a trolley assembly having a frame encompassing said bed, said trolley adapted for movement along said length of said bed, said trolley straddling said width of said bed, said trolley further comprising, c) a cylindrical print roller rotatably mounted on a bracket movably positioned in said frame, wherein said print roller may be raised and lowered with respect to said bed, d) a least one support roller mounted on said frame in rolling contact with said print roller whereby said at least one support roller provides stiffening support to said print roller, e) first and second screws whose rotational positions relative to said frame raises and lowers said bracket relative to said bed, f) first and second springs in engagement with said first and second screws, wherein said first and said second springs apply pressure to said bracket and said print roller dependent upon the rotational position of said first and said second screws, g) first and second handles for rotating said first and said second screws, and h) a third handle for rotating said print roller, wherein when said bed is under pressure exerted by said print roller, said trolley is frictionally movable along said length of said bed by rotation of said third handle.

11. The press of claim 10 wherein a multiplicity of rollers attached to said frame and contacting said bed, provide guidance of said trolley in movement along said length of said bed.

12. The press of claim 10 wherein a support roller is mounted in said frame contacting the underside of said bed, whereby said support roller provides stiffening of said bed under pressure exerted by said print roller on said bed.

13. The press of claim 12 wherein said support roller is in rolling contact with a multiplicity of bearings secured to said frame.

14. The press of claim 10 wherein said bracket is surmounted by a housing comprising a multiplicity of adjustment screws, said adjustment screws controlling the maximum excursion of said bracket in lifting said print roller above said bed.

15. The press of claim 10 wherein the pressure exerted by said first and said second springs is a linear function of the physical lengths of said springs.

16. The printing press of claim 15 further comprising first and second pressure indicators wherein the pressures exerted by said first and second springs are displayed.

17. The press of claim 10 wherein the pressures exerted by said first and said springs are nonlinear functions of the lengths thereof.

18. The printing press of claim 17 further comprising first and second pressure indicators wherein the pressures exerted by said first and second springs are displayed.

19. The press of claim 17 wherein said first and said second springs comprise the combination of spring components having two distinguishable spring constants.

20. The printing press of claim 19 further comprising first and second pressure indicators wherein the pressures exerted by said first and second springs are displayed.

21. The press of claim 19 wherein said first and said second nonlinear springs comprise first and second sets of stacked Belleville washers, said first and second sets differing in mechanical spring properties.

22. The printing press of claim 21 further comprising first and second pressure indicators wherein the pressures exerted by said first and second springs are displayed.

23. In a printing press including a print roller, a printing block plate and print fabricating material in contact with said printing block plate, the improvement comprising:

a) at least two springs adapted to apply pressure to said print roller, whereby said pressure forces said print roller into intimate contact with said printing block plate and said print fabricating material to effect printing by said press, wherein the pressure exerted by said springs is a nonlinear function of the lengths thereof.

24. The printing press of claim 23 further comprising first and second pressure indicators wherein the pressures exerted by said first and second springs are displayed.

25. The press of claim 23 wherein said springs comprise the combination of spring components having two distinguishable spring constants.

26. The printing press of claim 25 further comprising first and second pressure indicators wherein the pressures exerted by said first and second springs are displayed.

27. The press of claim 25 wherein said nonlinear springs comprise first and second sets of stacked Belleville washers, said first and second sets differing in mechanical spring properties.

28. The printing press of claim 27 further comprising first and second pressure indicators wherein the pressures exerted by said first and second springs are displayed.

* * * * *